US008651803B2

(12) United States Patent
Jones et al.

(10) Patent No.: US 8,651,803 B2
(45) Date of Patent: Feb. 18, 2014

(54) VARIABLE STATOR VANE ASSEMBLIES

(75) Inventors: Gareth J. Jones, Leicester (GB); Stephanie Maimari, Derby (GB)

(73) Assignee: Rolls-Royce PLC, London (GB)

( * ) Notice: Subject to any disclaimer, the term of this patent is extended or adjusted under 35 U.S.C. 154(b) by 768 days.

(21) Appl. No.: 12/876,390

(22) Filed: Sep. 7, 2010

(65) Prior Publication Data

US 2011/0058932 A1 Mar. 10, 2011

(30) Foreign Application Priority Data

Sep. 10, 2009 (GB) ..... 0915786.8

(51) Int. Cl.
*F01D 17/16* (2006.01)

(52) U.S. Cl.
USPC ..... 415/160; 74/519

(58) Field of Classification Search
USPC ..... 415/159–166; 74/519
See application file for complete search history.

(56) References Cited

U.S. PATENT DOCUMENTS

| | | | | |
|---|---|---|---|---|
| 6,019,574 | A | 2/2000 | DiBella | |
| 7,344,355 | B2 * | 3/2008 | Wilshaw | 415/160 |
| 2005/0271502 | A1 | 12/2005 | Burgmeier et al. | |

FOREIGN PATENT DOCUMENTS

| | | | |
|---|---|---|---|
| FR | 2904669 | A1 | 8/2006 |
| GB | 1 409 502 | A | 10/1975 |
| GB | 2 296 049 | A | 6/1996 |
| GB | 2 412 947 | A | 10/2005 |

OTHER PUBLICATIONS

British Search Report dated Dec. 17, 2009 in British Patent Application No. GB0915786.8.
Sep. 13, 2013 European Search Report issued in Application No. EP 10175391.

* cited by examiner

*Primary Examiner* — Christopher Verdier
(74) *Attorney, Agent, or Firm* — Oliff PLC

(57) ABSTRACT

A variable stator vane assembly for a gas turbine engine has a projection protruding from the upper stem of the vane and which engages an aperture in the vane lever to provide a visual indication of correct alignment between the lever and the vane.

15 Claims, 3 Drawing Sheets

VARIABLE STATOR VANE ASSEMBLIES

This invention concerns improvements in or relating to variable stator vane assemblies.

The compressor of a conventional gas turbine engine, as used for example on jet aircraft, comprises a number of rows of stator vanes and corresponding rotor blades. At least some of these stator vanes may be variable stator vanes which can be rotated about a radial direction to provide a desired air angle onto the following rotor blades at different engine speeds. Typically variable stator vanes are connected by a bolt to one end of a respective lever arm, with the other end of the lever arm pivotally mounted to a ring. The ring can be moved about the engine's axis to vary the inclination of the vanes.

It is sometimes necessary to remove the blade retention bolt, for instance to allow instrumentation to be fitted during testing. When the bolt is replaced it is important to ensure that the correct relative alignment between the stator vane and lever arm has been retained. Otherwise with a misalignment, a once-per-revolution aerodynamic excitation can occur, leading to disc post cracking and failure.

The direction upper when used in this specification is to be understood as meaning radially outwards, and other terms such as top and underside, are to be correspondingly understood.

According to the present invention there is provided a variable stator vane assembly for a gas turbine engine, the assembly including a stator vane with an airfoil and an upper stem section extending therefrom, a lever arm engagable on an upper surface of the upper stem when mounted to the stator vane, and retaining means for retaining the lever arm mounted on the stator vane, the upper stem section having a formation between the upper surface thereof and the airfoil with at least one engagement face, a corresponding projecting formation on the underside of the lever arm, which projecting formation is engageable against said engagement face when the lever arm is mounted on the stator vane for transmitting torque from the lever arm to the upper stem section and a recess extending into the upper stem section from the upper surface, the recess being threaded to receive a correspondingly threaded securing element to secure the lever arm to the upper stem; characterised in that the upper surface has an alignment projection that passes at least partially through an aperture in the lever arm and is visible when the lever arm and upper stem section are engaged, the alignment projection and aperture being arranged such that there is only full mounting of the lever arm on the stator vane at one respective axial orientation.

Preferably the upper surface has a region defined between two chords symmetrical about a diametric line across the top of the stem with the at least one engagement face downwardly inclined from the region.

Preferably there are two engagement faces each being downwardly inclined from a respective chords.

The chords may be spaced from the diametric line by a distance that is ¼ of the length of the diametric line.

Preferably the projection extends outwardly from the region. Preferably the projection does not extend beyond the upper surface of the lever arm. Preferably the width of the projection is less than the distance between the two chords.

The upper stem section is preferably substantially circular in cross section.

The retaining means may include alignable holes in the stator vane upper stem and lever arm, and a bolt extendable through the hole in the lever arm and engageable in the hole in the stator vane upper stem to retain the lever arm thereon.

The aperture in the lever arm may be integral with the alignable hole in the lever arm. Alternatively, there may be a separate aperture specifically for the projection.

The hole in the upper stem may be off centre. The top edges of the engagement faces may extend in substantially equispaced alignment from the centre of the hole in the upper stem.

The lever arm preferably includes a pair of projecting formations which each include an inwardly facing inclined surface engageable against, and substantially parallel to, a respective engagement face on the stator vane, when the lever arm is mounted thereon.

The lever arm and stator vane may be arranged such that when mounted together substantially only the inclined surfaces on the lever arm and the engagement faces on the stator vane are engageable with each other.

The invention also provides a compressor for a gas turbine engine, the compressor including a plurality of variable stator vane assemblies according to any of the preceding eleven paragraphs.

An embodiment of the present invention will now be described by way of example only and with reference to the accompanying drawings, in which.

Figure 1:
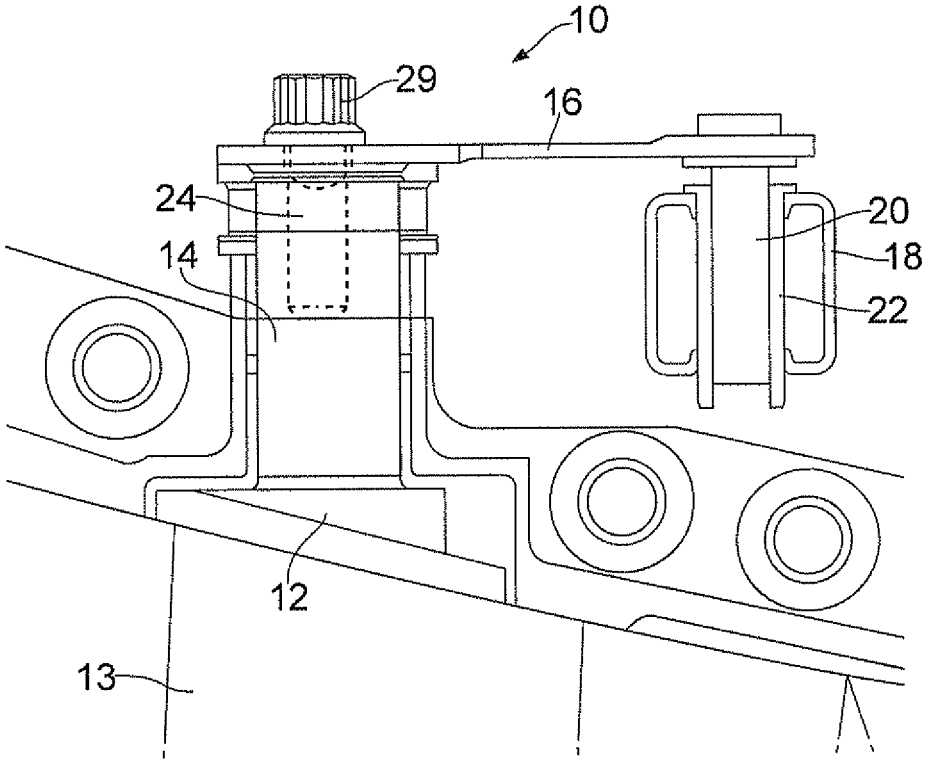
FIG. 1 is a diagrammatic side view of part of a variable stator vane assembly according to the invention.
Figure 2:
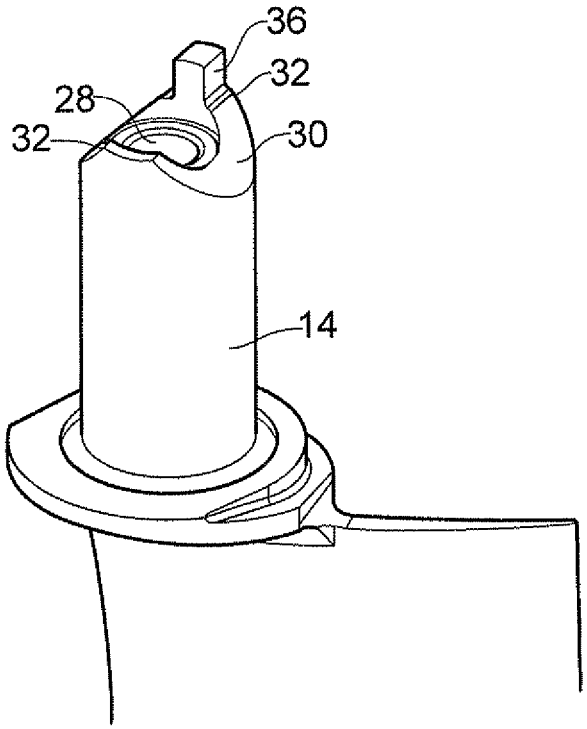
FIG. 2 is a diagrammatic perspective view of part of a first component of the assembly of FIG. 1.

The drawings show a variable stator vane assembly 10. The assembly comprises a stator vane 12 with an airfoil 13 from which an upper stem 14 extends. The upper stem 14 is mounted to one end of a lever arm 16. The other end of the lever arm 16 is pivotally mounted to a ring 18. The pivotal mounting is provided by a downwardly extending finger 20 on the lever arm 16, which finger 20 rotatably locates in a bushing 22 provided in a hole in the ring 18. Each ring 18 will mount a number of lever arms 16 circumferentially around the engine. The lever arm 16 is mounted to the upper stem 14 by virtue of a bolt 24. The bolt 24 passes through an opening 26 in the lever arm 16, and threadably engages in an off centre hole 28 in the upper stem 14. The head 29 of the bolt 24 engages against the lever arm 16.

The upper surface of the upper stem 14 is profiled as follows. A pair of outwardly downwards inclined engagement faces 30 are provided extending from the upper surface towards the aerofoil. The faces 30 are at a corresponding angle and symmetrical about a diametric line across the top of the generally cylindrical upper stem 14.

The top edges of the inclined faces do not extend to the diametric line but instead extend to chords 32 parallel with, and symmetrically spaced from the diametric line.

The underside of the lever arm 16 around the opening 26 has a pair of projections engageable respectively with the faces 30.

In use, the stator vane 12 and lever arm 16 are mounted together as shown in FIG. 1. These components are arranged such that when mounted together substantially only the engagement faces and respective engagement surfaces are in contact with each other. The arrangement of the faces 30 and surfaces reacts out the tightening torque of the bolt 24 being tightened against the lever arm 16 and stator vane 12.

To prevent the vane being mounted at an incorrect alignment a projection 36 is machined into the upper section of the vane stem. The projection has a height less than the thickness of the vane lever so that it does not protrude from the upper surface of the vane lever and interfere with the securing of the lever and stem by the bolt 29, which can be used in the normal manner. The projection, by being provided in the chordal region of the upper section, does not interfere with the engaging faces 30 of the vane stem enabling large faces to be used.

Figure 3:
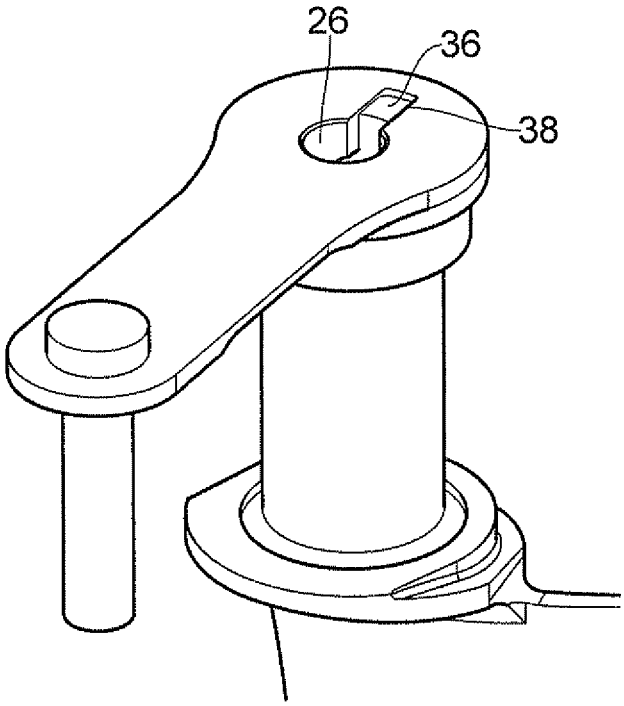
FIG. 3 is a diagrammatic perspective view of a second component of the assembly of FIG. 1.
Figure 4:
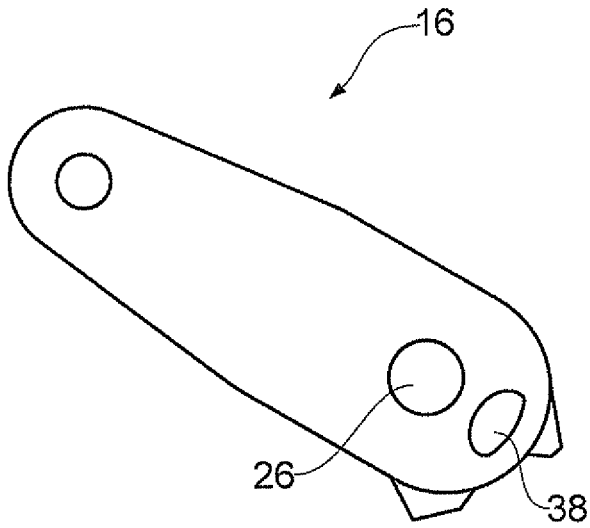
FIG. 4 is a diagrammatic perspective view of an alternative embodiment of vane lever.

The vane lever is provided with an aperture 38 (FIG. 4) or a cut-out (FIG. 3) within which the projection sits during operation of the variable guide vane.

The projection 36 has a width that is less than the width of the chordal region and when inserted through the vane lever does not touch the sides of the lever so as to avoid torque being transferred through the projection and possibly imparting damage to the projection. The projection is not load bearing in any way during engine operation.

If an attempt is made to mount the lever arm 16 on the stator vane 12 at an incorrect alignment, the projection 36 will not fit into the aperture 38, and thus the lever arm 16 will be significantly raised away from the stator vane 12, therefore providing a clear visual indication that the assembly 10 has not been correctly mounted together.

Beneficially, the operator assembling the variable guide vane can visually observe the projection 36 within the aperture before the bolt 29 is tightened and the lever secured to the vane stem.

This arrangement thus only permits mounting together of the stator vane 12 and lever arm 16 in a correct alignment, and provides a clear visual indication if this alignment is not provided. The arrangement does not require significant extra machining relative to conventional arrangements without this feature, and thus does not provide a significant cost prohibition. The arrangement reacts out tightening torque so the lever arm does not tend to ride up relative to the stator vane. This arrangement provides engagement over a relatively large area of the inclined faces and surfaces, thereby avoiding the need to provide precise clearances and also avoiding any potential backlash.

It is to be realised that various modifications may be made without departing from the scope of the invention. For instance, retaining means other than the bolt described could be used. The engagement faces may have a different form. In addition the location of the aperture and projection need not be on the opposite side of the bolt to the main portion of the lever arm. The projection could be located on the stem of the vane to engage an aperture in the lever arm in any circumferential location around the bolt hole aperture provided the shape of the engagement faces and top surface permit or are modified to permit it.

The invention claimed is:

1. A variable stator vane assembly for a gas turbine engine, the assembly including a stator vane with an airfoil and an upper stem section extending from the airfoil, a lever arm engageable on an upper surface of the upper stem section when mounted to the stator vane, and a retaining element for retaining the lever arm mounted on the stator vane, the upper stem section having a formation between the upper surface thereof and the airfoil with at least one engagement face, a corresponding projecting formation on the underside of the lever arm, which projecting formation is engageable against said engagement face when the lever arm is mounted on the stator vane for transmitting torque from the lever arm to the upper stem section and a recess extending into the upper stem section from the upper surface, the recess being threaded to receive the retaining element to retain the lever arm to the upper stem section;

characterised in that the upper surface has an alignment projection that passes at least partially through an aperture in the lever arm and is visible when the lever arm and upper stem section are engaged, the alignment projection and aperture being arranged such that there is only full mounting of the lever arm on the stator vane at one respective axial orientation.

2. An assembly according to claim 1, wherein the upper surface has a region defined between two chords symmetrical about a diametric line across the top of the upper stem section with the at least one engagement face downwardly inclined from the region.

3. An assembly according to claim 2, wherein there are two engagement faces each being downwardly inclined from a respective chord.

4. An assembly according to claim 2, wherein the chords are spaced from the diametric line by a distance that is ¼ of the length of the diametric line.

5. An assembly according to claim 2, wherein the alignment projection extends outwardly from the region.

6. An assembly according to claim 5, wherein the width of the alignment projection is less than the distance between the two chords.

7. An assembly according to claim 1, wherein the alignment projection does not extend beyond the upper surface of the lever arm.

8. An assembly according to claim 1, wherein the upper stem section is substantially circular in cross section.

9. An assembly according to claim 1, wherein the retaining means includes alignable holes in the upper stem section and the lever arm, and a bolt extendable through the hole in the lever arm and engageable in the hole in the upper stem section to retain the lever arm thereon.

10. An assembly according to claim 9, wherein the aperture in the lever arm is integral with the alignable hole in the lever arm.

11. An assembly according to claim 9, wherein the aperture in the lever arm is separate from the alignable hole in the lever arm.

12. An assembly according to claim 9, wherein the alignable hole in the upper stem section is off centre.

13. An assembly according to claim 1, wherein the lever arm includes a pair of projecting formations which each include an inwardly facing inclined surface engageable against, and substantially parallel to, a respective engagement face on the stator vane, when the lever arm is mounted thereon.

14. An assembly according to claim 13, wherein the lever arm and stator vane are arranged such that when mounted together substantially only the inclined surfaces on the lever arm and the engagement faces on the stator vane are engageable with each other.

15. A compressor for a gas turbine engine, the compressor including a plurality of variable stator vane assemblies according to claim 1.

* * * * *